US011149219B2

(12) United States Patent
Choi et al.

(10) Patent No.: US 11,149,219 B2
(45) **Date of Patent: *Oct. 19, 2021**

(54) ENHANCED VISBREAKING PROCESS

(71) Applicant: SAUDI ARABIAN OIL COMPANY, Dhahran (SA)

(72) Inventors: Ki-Hyouk Choi, Dhahran (SA); Mohnnad H. Alabsi, Dhahran (SA); Muneef F. Alqarzouh, Dhahran (SA); Rakan S. Mubayedh, Alkhobar (SA); Sung Ho Choi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/720,887

(22) Filed: Dec. 19, 2019

(65) Prior Publication Data

US 2021/0189263 A1 Jun. 24, 2021

(51) Int. Cl.
*C10G 69/06* (2006.01)
*C10G 31/08* (2006.01)
(Continued)

(52) U.S. Cl.
CPC ..... *C10G 69/06* (2013.01); *C10G 7/06* (2013.01); *C10G 9/007* (2013.01); *C10G 31/08* (2013.01);
(Continued)

(58) Field of Classification Search
CPC ..... C10G 9/007; C10G 9/14; C10G 31/08; C10G 51/023; C10G 65/12; C10G 69/06
See application file for complete search history.

(56) References Cited

U.S. PATENT DOCUMENTS 4,169,782 A 10/1979 Thompson
4,477,334 A 10/1984 Gomi et al.
(Continued)

FOREIGN PATENT DOCUMENTS

CN 106987265 A 7/2017
WO 2011033685 A1 3/2011
(Continued)

OTHER PUBLICATIONS

Kishita, et al., Upgrading of Bitumen by Hydrothermal Visbreaking in Supercritical Water with Alkali, Journal of the Japan Petroleum Institute,46 (4), 215-221 (2003).
(Continued)

*Primary Examiner* — Renee Robinson
(74) *Attorney, Agent, or Firm* — Bracewell LLP; Constance Gall Rhebergen

(57) ABSTRACT

Embodiments of the disclosure provide a visbreaking system and method for upgrading heavy hydrocarbons. A heavy hydrocarbon feed is introduced to a furnace to produce a soaker feed stream. The soaker feed stream is introduced to a soaker to produce a soaker effluent stream. The soaker effluent stream is introduced to a fractionator to produce a visbreaker distillate stream and a visbreaker residue stream. The visbreaker residue stream and a water feed are introduced to a supercritical water reactor operated at supercritical conditions of water to produce an effluent stream. The effluent stream is introduced to a flash column to produce a gas phase stream including water and a liquid phase stream including water. A portion of the liquid phase stream and the heavy hydrocarbon feed is combined. Optionally, a portion of the gas phase stream and the heavy hydrocarbon feed is combined. Optionally, a portion of the gas phase stream is introduced to the fractionator.

14 Claims, 2 Drawing Sheets

(51) Int. Cl.
*C10G 9/00* (2006.01)
*C10G 7/06* (2006.01)

(52) U.S. Cl.
CPC ..... *C10G 2300/301* (2013.01); *C10G 2300/4006* (2013.01); *C10G 2300/807* (2013.01)

(56) References Cited

U.S. PATENT DOCUMENTS

| | | | |
|---|---|---|---|
| 4,483,761 | A | 11/1984 | Paspek, Jr. |
| 4,846,958 | A | 7/1989 | Feldman et al. |
| 5,925,236 | A | 7/1999 | Fersing et al. |
| 7,909,985 | B2 | 3/2011 | Hong et al. |
| 8,864,978 | B2 | 10/2014 | Choi |
| 9,039,889 | B2 | 5/2015 | Choi et al. |
| 9,771,527 | B2 | 9/2017 | Choi et al. |
| 9,925,532 | B2 | 3/2018 | Zhao et al. |
| 2010/0320119 | A1 | 12/2010 | John et al. |
| 2018/0258353 | A1 | 9/2018 | Choi et al. |
| 2018/0265792 | A1 | 9/2018 | Choi et al. |
| 2019/0316045 | A1 * | 10/2019 | Choi ..... C10G 7/06 |

FOREIGN PATENT DOCUMENTS

| | | | |
|---|---|---|---|
| WO | 2017096467 | A1 | 6/2017 |
| WO | 2019200029 | A1 | 10/2019 |

OTHER PUBLICATIONS

Marzin, et al., "New Residue Process Increases Conversion, Produces Stable Residue in Curacao Refinery," Oil & Gas Journal, vol. 96., Issue 44 (1998).
Speight, "Visbreaking: A technology of the past and the future", Scientia Iranica C, vol. 19, p. 569 (2012).
Wiehe, "A Phase-Separation Kinetic Model for Coke Formation", Ind. Eng. Chern. Res., vol. 32, pp. 2447-245 (1993).
PCT ISRWO dated Mar. 31, 2021, in the prosecution of International Application No. PCT/US2020/065743, 13 pages.

* cited by examiner

ENHANCED VISBREAKING PROCESS

BACKGROUND

Field of the Disclosure

Embodiments of the disclosure generally relate to upgrading hydrocarbons. More specifically, embodiments of the disclosure relate to a method and system for upgrading heavy hydrocarbons by using an integrated visbreaking and supercritical water process.

Description of the Related Art

Heavy hydrocarbons such as atmospheric residue or vacuum residue generally require varying degrees of conversion to increase their value and usability, including the reduction of viscosity to facilitate subsequent refining into light distillates products such as gasoline, naphtha, diesel and fuel oil. One approach to reduce the viscosity of heavy hydrocarbons is to blend heavy hydrocarbons with lighter oil, known as cutter stocks, to produce liquid hydrocarbon mixtures of acceptable viscosity. However, this has the disadvantage of consuming valuable, previously fractioned liquid hydrocarbon mixtures.

Other processes for conversion of heavy hydrocarbons into light distillates and reduction in the viscosity include catalytic processes such as fluid catalytic cracking (FCC), hydrocracking, and thermal cracking processes such as visbreaking or coking. These processes increase the product yield and reduce the requirement for valuable cutter stock as compared to blending alone.

Thermal cracking processes are well established and exist worldwide. In these processes, heavy gas oil or vacuum residue are thermally cracked in reactors which operate at relatively high temperatures (for example, between about 425 deg. C. and about 540 deg. C.) and low pressures (for example, between about 0.3 bar and about 15 bar) to crack large hydrocarbon molecules into smaller, more valuable compounds.

Visbreaking processes reduce the viscosity of the heavy hydrocarbons and increase the distillate yield in the overall refining operation by production of gas oil feeds for catalytic cracking. To achieve these goals, a visbreaking reactor is operated at sufficiently severe conditions to generate sufficient quantities of the lighter products.

There are two types of visbreaking technologies that are commercially available: 'coil' or 'furnace' type processes and 'soaker' processes. In coil processes, conversion is achieved by high temperature cracking for a predetermined, relatively short period of time in the heater. In soaker processes, which are low temperature/long residence time processes, the majority of conversion occurs in a reaction vessel or a soaker drum, where the effluent of the furnace is maintained at a comparatively lower temperature for a longer period of time.

Visbreaking processes convert a limited amount of heavy hydrocarbons to lower viscosity light oil. However, the asphaltene content of heavy hydrocarbon feeds severely restricts the degree of visbreaking conversion, likely due to the tendency of the asphaltenes to condense into heavier materials such as coke, thus causing instability in the resulting fuel oil.

Hydrocarbon conversion under supercritical water conditions is similar to conventional thermal processes such as coking and visbreaking where radical-mediated reactions dominate. Supercritical water provides a dilution effect which suppresses bimolecular or multimolecular reactions. Supercritical water can serve as a hydrogen source for steam reforming reactions and water-gas shift reactions. The presence of supercritical water in thermal processing of hydrocarbons suppresses coke formation as well as gas formation.

SUMMARY

Embodiments of the disclosure generally relate to upgrading hydrocarbons. More specifically, embodiments of the disclosure relate to a method and system for upgrading heavy hydrocarbons by using an integrated visbreaking and supercritical water process.

Embodiments of the disclosure provide a method for upgrading heavy hydrocarbons.

The method includes the step of introducing a heavy hydrocarbon feed to a furnace to produce a soaker feed stream. The heavy hydrocarbon feed includes the heavy hydrocarbons. The method includes the step of introducing the soaker feed stream to a soaker to produce a soaker effluent stream. The method includes the step of introducing the soaker effluent stream to a fractionator to produce a visbreaker distillate stream and a visbreaker residue stream. The visbreaker distillate stream comprises hydrocarbons having a true boiling point (TBP) less than that of the visbreaker residue stream. The method includes the step of introducing the visbreaker residue stream and a water feed to a supercritical water reactor (SCW reactor). The SCW reactor is operated at a pressure equal to or greater than 220.6 bar and a temperature equal to or greater than 373.9 deg. C. to produce a supercritical water effluent (SCW effluent) stream. The method includes the step of introducing the SCW effluent stream to a flash column to produce a gas phase stream and a liquid phase stream. The gas phase stream includes water. The liquid phase stream includes water. The method includes the step of combining a portion of the liquid phase stream and the heavy hydrocarbon feed.

In some embodiments, the heavy hydrocarbons include an atmospheric residue fraction, a vacuum residue fraction, and combinations thereof. In some embodiments, the method further includes the step of combining a portion of the gas phase stream and the heavy hydrocarbon feed. In some embodiments, the method further includes the step of pressurizing the heavy hydrocarbon feed to a pressure ranging between 30 bar and 40 bar. The method further includes the step of heating the heavy hydrocarbon feed to a temperature ranging between 150 deg. C. and about 350 deg. C. In some embodiments, the furnace is operated such that the soaker feed stream has a temperature ranging between 425 deg. C. and 500 deg. C. In some embodiments, the soaker effluent stream has a temperature ranging between 375 deg. C. and about 450 deg. C. In some embodiments the visbreaker distillate stream includes hydrocarbons having a TBP less than 340 deg. C. In some embodiments, the method further includes the step of introducing a make-up water feed to the fractionator. In some embodiments, the method further includes the step of introducing a portion of the gas phase stream to the fractionator. In some embodiments, the method further includes the step of pressurizing the visbreaker residue stream to a pressure ranging between 260 bar and 300 bar. The method further includes the step of heating the visbreaker residue stream to a temperature ranging between 170 deg. C. and about 220 deg. C. In some embodiments, the method further includes the step of pressurizing the water feed to a pressure ranging between 260 bar and 300 bar. The method further includes the step of heating the water feed to a temperature ranging between 450 deg. C. and about 600 deg. C. In some embodiments, the visbreaker residue stream and the water feed are introduced to the SCW reactor having a water-to-oil mass flow ratio ranging between 1 and 5. In some embodiments, the method further includes the step of cooling the SCW effluent stream to a temperature ranging between 150 deg. C. and about 280 deg. C. The method further includes the step of depressurizing the SCW effluent stream to a pressure ranging between 1 bar and 15 bar. In some embodiments, the gas phase stream includes hydrocarbons having a TBP 90% less than 360 deg. C. and the liquid phase stream includes hydrocarbons having a TBP 10% equal to or greater than 360 deg. C. In some embodiments, the gas phase stream has a water content ranging between 80 wt. % and 95 wt. %. In some embodiments, the liquid phase stream has a water content ranging between 50 wt. % and 60 wt. %.

Embodiments of the disclosure also provide a visbreaking system for upgrading heavy hydrocarbons. The visbreaking system includes a first pump, a first heat exchanger, a mixer, a furnace, a soaker, a fractionator, a second pump, a second heat exchanger, a third pump, a third heat exchanger, an SCW reactor, a fourth heat exchanger, a pressure reducer, and a flash column. The first pump is configured to pressurize a heavy hydrocarbon feed to a pressure ranging between 30 bar and 40 bar. The heavy hydrocarbon feed includes the heavy hydrocarbons. The first heat exchanger is configured to heat the heavy hydrocarbon feed to a temperature ranging between 150 deg. C. and about 350 deg. C. The mixer is fluidly connected downstream of the first pump and the first heat exchanger and fluidly connected downstream of the flash column. The mixer is configured to combine the heavy hydrocarbon feed and a portion of a liquid phase stream to produce a furnace feed stream. The furnace is fluidly connected downstream of the mixer. The furnace is configured to heat the furnace feed stream to a temperature ranging between 425 deg. C. and 500 deg. C. to produce a soaker feed stream. The soaker is fluidly connected downstream of the furnace. The soaker is configured to allow the heavy hydrocarbons to undergo conversion reactions to produce a soaker effluent stream. The fractionator is fluidly connected downstream of the soaker. The fractionator is configured to separate the soaker effluent stream into a visbreaker distillate stream and a visbreaker residue stream. The visbreaker distillate stream includes hydrocarbons having a TBP 90% less than 340 deg. C. The visbreaker residue stream includes hydrocarbons having a TBP 10% equal to or greater than 340 deg. C. The second pump is fluidly connected downstream of the fractionator. The second pump is configured to pressurize a portion of the visbreaker residue stream to a pressure ranging between 260 bar and 300 bar. The second heat exchanger is fluidly connected downstream of the fractionator. The second heat exchanger is configured to heat the portion of the visbreaker residue stream to a temperature ranging between 170 deg. C. and 220 deg. C. The third pump is configured to pressurize a water feed to a pressure ranging between 260 bar and 300 bar. The third heat exchanger is configured to heat the water feed to a temperature ranging between 450 deg. C. and 600 deg. C. The SCW reactor is fluidly connected downstream of the second pump and the second heat exchanger and fluidly connected downstream of the third pump and the third heat exchanger. The SCW reactor is operated at a operated at a pressure equal to or greater than 220.6 bar and a temperature equal to or greater than 373.9 deg. C. to produce an SCW effluent stream. The fourth heat exchanger is fluidly connected downstream of the SCW reactor. The fourth heat exchanger is configured to cool the SCW effluent stream to a temperature ranging between 150 deg. C. and 280 deg. C. The pressure reducer is fluidly connected downstream of the SCW reactor. The pressure reducer is configured to depressurize the SCW effluent stream to a pressure ranging between 1 bar and 15 bar. The flash column is fluidly connected downstream of the fourth heat exchanger and the pressure reducer. The flash column is configured to separate the SCW effluent stream into a gas phase stream and the liquid phase stream. The gas phase stream includes hydrocarbons having a TBP 90% less than 360 deg. C. The liquid phase stream includes hydrocarbons having a TBP 10% equal to or greater than 360 deg. C. The gas phase stream has a water content ranging between 80 wt. % and 95 wt. %. The liquid phase stream has a water content ranging between 50 wt. % and 60 wt. %.

In some embodiments, the mixer is configured to combine the heavy hydrocarbon feed, the portion of the liquid phase stream, and a portion of the gas phase stream to produce the furnace feed stream. In some embodiments, a make-up water feed is introduced to the fractionator. In some embodiments, a portion of the gas phase stream is introduced to the fractionator.

BRIEF DESCRIPTION OF THE DRAWINGS

So that the manner in which the previously-recited features, aspects, and advantages of the embodiments of this disclosure as well as others that will become apparent are attained and can be understood in detail, a more particular description of the disclosure briefly summarized previously may be had by reference to the embodiments that are illustrated in the drawings that form a part of this specification. However, it is to be noted that the appended drawings illustrate only certain embodiments of the disclosure and are not to be considered limiting of the disclosure's scope as the disclosure may admit to other equally effective embodiments.

Figure 1:
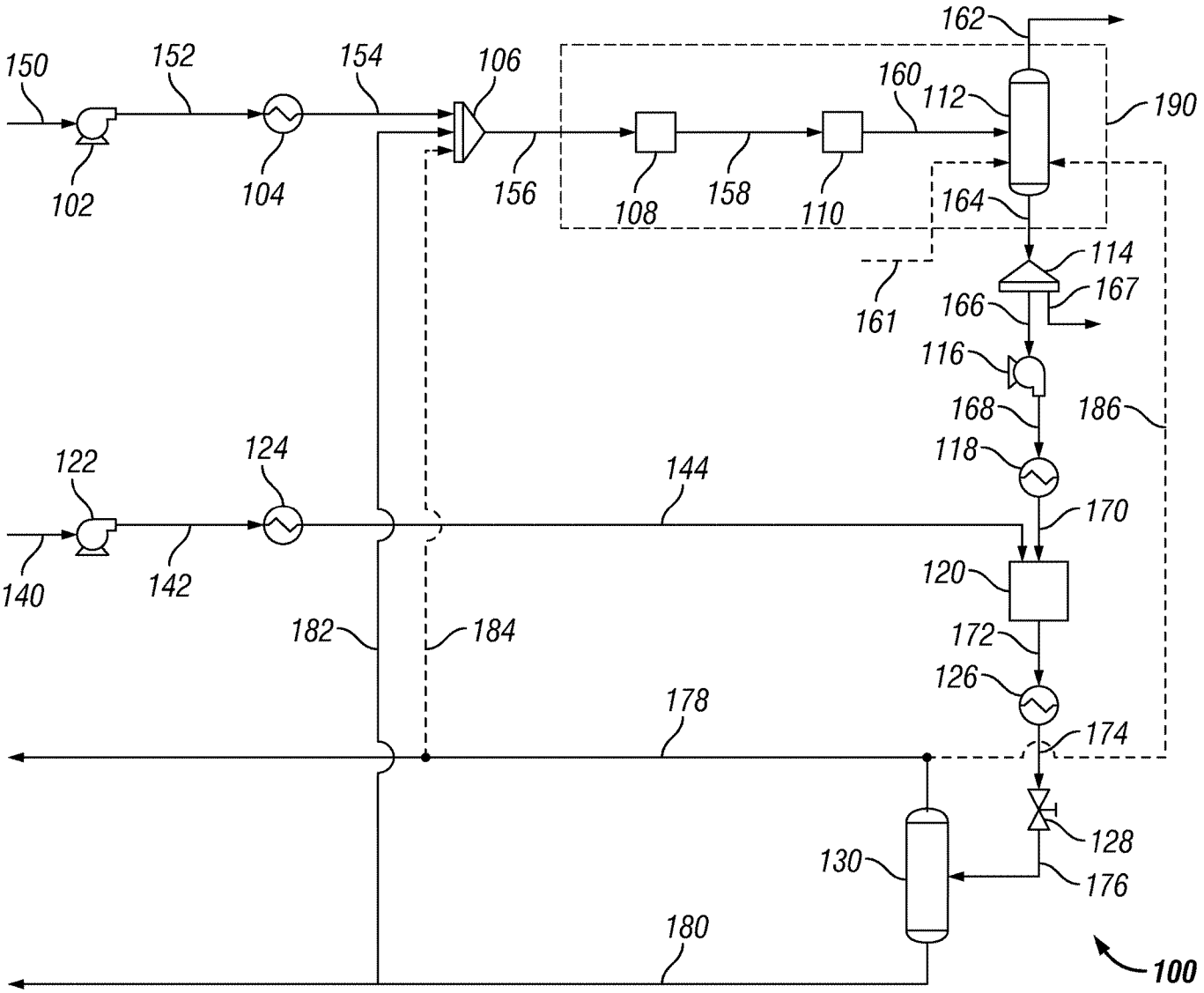
FIG. 1 is a schematic diagram of a process for upgrading heavy hydrocarbons according to an embodiment of the disclosure.

In the accompanying Figures, similar components or features, or both, may have a similar reference label.

DETAILED DESCRIPTION

The disclosure refers to particular features, including process or method steps and systems. Those of skill in the art understand that the disclosure is not limited to or by the description of embodiments given in the specification. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used throughout the disclosure, the singular forms "a," "an," and "the" include plural references unless the context clearly indicates otherwise.

As used throughout the disclosure, the word "about" includes +/−5% of the cited magnitude. The word "substantially" includes +/−5% of the cited magnitude.

As used throughout the disclosure, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

As used throughout the disclosure, the words "optional" or "optionally" means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms described the relative position of an object or a group of objects relative to another object or group of objects. The spatial relationships apply along vertical and horizontal axes. Orientation and relational words such are for descriptive convenience and are not limiting unless otherwise indicated.

As used throughout the disclosure, the term "atmospheric residue" refers to the fraction of oil-containing streams having an initial boiling point (IBP) of 340 deg. C., such that all of the hydrocarbons have boiling points greater than 340 deg. C. and includes the vacuum residue fraction. Atmospheric residue can refer to the composition of an entire stream, such as when the feedstock is from an atmospheric distillation unit, or can refer to a fraction of a stream, such as when a whole range crude is used.

As used throughout the disclosure, the term "vacuum residue" refers to the fraction of oil-containing streams having an IBP of 540 deg. C. Vacuum residue can include a fraction having a TBP 10% equal to or greater than about 565 deg. C. Vacuum residue can refer to the composition of an entire stream, such as when the feedstock is from a vacuum distillation unit or can refer to a fraction of stream, such as when a whole range crude is used.

As used throughout the disclosure, the term "asphaltene" refers to the fraction of an oil-containing stream which is not soluble in a n-alkane, particularly, n-heptane.

As used throughout the disclosure, the term "heavy hydrocarbon" refers to the fraction in the petroleum feed having a TBP 10% that is equal to or greater than about 340 deg. C., or alternately equal to or greater than about 540 deg. C. In at least one embodiment, the heavy fraction has a TBP 10% that is equal to or greater than about 540 deg. C. Examples of a heavy fraction can include the atmospheric residue fraction or vacuum residue fraction. The heavy fraction can include components from the petroleum feed that were not converted in an SCW reactor. The heavy fraction can also include hydrocarbons that were dimerized or oligomerized in the SCW reactor due to either lack of hydrogenation or resistance to thermal cracking.

As used throughout the disclosure, the terms "naphtha fraction" or "naphtha" refer to a hydrocarbon fraction having a TBP 10% of about 30 deg. C. and a TBP 90% of about 180 deg. C.

As used throughout the disclosure, the terms "light gas oil fraction" or "light gas oil" refer to a hydrocarbon fraction having a TBP 10% of 180 deg. C. and a TBP 90% of about 340 deg. C.

As used throughout the disclosure, the terms "vacuum gas oil fraction" or "vacuum gas oil" refer to a hydrocarbon fraction having a TBP 10% of 340 deg. C. and a TBP 90% of about 565 deg. C.

As used throughout the disclosure, the term "coke" refers to a toluene insoluble material that is present in petroleum or is formed in a reactor.

As used throughout the disclosure, the term "cracking" refers to the breaking of hydrocarbons into smaller ones containing few carbon atoms due to the breaking of carbon-carbon bonds.

As used throughout the disclosure, the term "upgrade" means one or all of increasing API gravity, decreasing the amount of impurities, such as sulfur, nitrogen, and metals, decreasing the amount of asphaltene, and increasing the amount of distillate in a process outlet stream relative to the process feed stream. One of skill in the art understands that upgrade can have a relative meaning such that a stream can be upgraded in comparison to another stream, but can still contain undesirable components such as impurities. Such upgrading results in increase of API gravity, shifting distillation curve to lower temperature, decrease of asphalthene content, decrease of viscosity, and increase of light fractions such as naphtha and diesel.

As used throughout the disclosure, the term "conversion reaction" refers to one or more reactions that can upgrade a hydrocarbon stream including cracking, isomerization, alkylation, dimerization, aromatization, cyclization, desulfurization, denitrogenation, deasphalting, and demetallization.

As used throughout the disclosure, the term "residence time" refers to a value equivalent to an internal volume of a certain reactor divided by the volumetric flow rate of a certain feedstock introduced to the reactor at operating conditions of the reactor.

It is known in the art that supercritical water has unique properties making it suitable for use as a petroleum reaction medium where the reaction objectives can include conversion reactions, desulfurization reactions, denitrogenation reactions, and demetallization reactions. Supercritical water is water at a temperature at or greater than the critical temperature of water and at a pressure at or greater than the critical pressure of water. The critical temperature of water is 373.946 deg. C. The critical pressure of water is 220.6 bar. Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water gas shift reaction.

Without being bound any theory, it is understood that the basic reaction mechanism of supercritical water mediated petroleum processes is similar to a free radical reaction mechanism. Radical reactions include initiation, propagation, and termination steps. With hydrocarbons, initiation is the most difficult step. Initiation requires the breaking of chemical bonds. The bond energy of carbon-carbon bonds (C—C) is about 350 kilojoules per mole (kJ/mol), while the bond energy of carbon-hydrogen bonds (C—H) is about 420 kJ/mol, both of which are considered high chemical bond energies. Due to the high chemical bond energies, carbon-carbon bonds and carbon-hydrogen bonds do not break easily at the temperatures in a supercritical water process, 380 deg. C. to 450 deg. C., without catalyst or radical initiators.

Thermal energy creates radicals through chemical bond breakage. Supercritical water creates a "cage effect" by surrounding the radicals. The radicals surrounded by water molecules cannot react easily with each other, and thus, intermolecular reactions that contribute to coke or char formation are suppressed. The cage effect suppresses coke or char formation by limiting inter-radical reactions. Supercritical water, having low dielectric constant, dissolves hydrocarbons and surrounds radicals to prevent the inter-radical reaction, which is the termination reaction resulting in condensation (dimerization or polymerization). Because of the barrier set by the supercritical water cage, hydrocarbon radical transfer is more difficult in supercritical water as compared to conventional thermal cracking processes, such as delayed coker, where radicals travel freely without such barriers.

FIG. 1 shows a schematic diagram of a process 100 for upgrading heavy hydrocarbons. The process 100 can include pump 102, heat exchanger 104, mixer 106, furnace 108, soaker 110, fractionator 112, splitter 114, pump 116, heat exchanger 118, pump 122, heat exchanger 124, SCW reactor 120, heat exchanger 126, pressure reducer 128, and flash column 130.

Heavy hydrocarbon feed 150 is introduced to the process 100. Heavy hydrocarbon feed 150 can be obtained from any heavy oil source derived from petroleum, coal liquid, or biomaterials. Non-limiting examples of heavy hydrocarbons can include whole range crude oil, distilled crude oil, residue oil, atmospheric residue, vacuum residue, vacuum gas oil, deasphalted oil, topped crude oil, refinery streams, product streams from steam cracking processes, liquefied coals, liquid products recovered from oil or tar sands, bitumen, oil shale, asphalthene, liquid hydrocarbons recovered from gas-to-liquid (GTL) processes, and biomass derived hydrocarbons. In at least one embodiment, heavy hydrocarbon feed 150 can include an atmospheric residue, a vacuum residue, a vacuum gas oil, and a deasphalted oil. "Whole range crude oil" refers to passivated crude oil which has been processed by a gas-oil separation plant after being recovered from a production well. "Topped crude oil" can also be known as "reduced crude oil" and refers to a crude oil having no light fraction, and would include an atmospheric residue stream or a vacuum residue stream. "Refinery streams" can include "cracked oil," such as light cycle oil, heavy cycle oil, and streams from an FCC, such as slurry oil or decant oil, a heavy stream from hydrocracker with a boiling point greater than 340 deg. C., a deasphalted oil (DAO) stream from a solvent extraction process, and a mixture of atmospheric residue and hydrocracker bottom fractions.

Heavy hydrocarbon feed 150 can have a TBP 20% greater than about 510 deg. C., alternately greater than about 400 deg. C., or alternately greater than about 340 deg. C. In at least one embodiment, heavy hydrocarbon feed 150 has a TBP 20% of about 340 deg. C. Heavy hydrocarbon feed 150 can include sulfur-containing hydrocarbons. The sulfur-containing hydrocarbons can include aliphatic sulfur compounds such as thiols, sulfides, and disulfides. heavy hydrocarbon feed 150 can have a total sulfur content greater than about 0.01 wt. %, alternately greater than about 0.05 wt. %, or alternately greater than about 0.1 wt. %. In at least one embodiment, the residual oil has a total sulfur content of about 5.4 wt. %.

Heavy hydrocarbon feed 150 is passed to pump 102 to produce heavy hydrocarbon stream 152. Pump 102 can be any type of pump capable of increasing the pressure of heavy hydrocarbon feed 150. Non-limiting examples of pump 102 can include a diaphragm metering pump and a plunger type pump. The pressure of heavy hydrocarbon stream 152 can range between about 5 bar and about 55 bar, alternately between about 15 bar and about 50 bar, or alternately between about 30 bar and about 40 bar. In at least one embodiment, the pressure of heavy hydrocarbon stream 152 is about 38 bar.

Heavy hydrocarbon stream 152 is passed to heat exchanger 104 to produce heavy hydrocarbon stream 154. Heat exchanger 104 can be any type of heat exchanger capable of increasing the temperature of heavy hydrocarbon stream 152. Non-limiting examples of heat exchanger 104 can include an electric heater, a fired heater, and a cross exchanger. The temperature of heavy hydrocarbon stream 154 can range between about 100 deg. C. and about 500 deg. C, alternately between about 150 deg. C. and about 400 deg. C., or alternately between about 150 deg. C. and about 350 deg. C. In at least one embodiment, the temperature of heavy hydrocarbon stream 154 is about 250 deg. C.

Optionally, heavy hydrocarbon feed 150 can be passed to a filter (not shown). The filter can be any type of filter capable of removing solid materials present in heavy hydrocarbon feed 150. The filter can reject solid particles greater than 10 millimeters (mm), alternately greater than 5 mm, or alternately greater than 1 mm. In at least one embodiment, heavy hydrocarbon feed 150 passes a filter such that solid materials having a size greater than 5 mm are removed.

Heavy hydrocarbon stream 154 is passed to mixer 106 to along with liquid phase stream 182 to produce furnace feed stream 156. Liquid phase stream 182 includes at least a portion of liquid phase stream 180 (described infra). Mixer 106 can be any type of mixing device capable of mixing the heavy hydrocarbon stream 154 and liquid phase stream 182. Non-limiting examples of mixing devices suitable for use as mixer 106 can include a static mixer, an inline mixer, and impeller-embedded mixer.

Furnace feed stream 156 is introduced to visbreaker unit 190. Visbreaker unit 190 can include furnace 108, soaker 110, and fractionator 112.

Furnace feed stream 156 is introduced into furnace 108 to produce soaker feed stream 158. Furnace 108 can be any type of furnace capable of increasing the temperature of furnace feed stream 156. Non-limiting examples of furnace 108 can include an electric heater and a fired heater. In some embodiments, furnace 108 can be a coil type furnace. Furnace 108 is operated such that furnace feed stream 156 is heated to a temperature ranging between about 400 deg. C. and about 550 deg. C., alternately between about 400 deg. C. and about 500 deg. C., or alternately between about 425 deg. C. and about 500 deg. C. In at least one embodiment, furnace feed stream 156 is heated to a temperature of about 450 deg. C. The residence time of the internal fluids in furnace 108 can range between about 0.5 minutes (min) to about 20 min, alternately between about 0.5 min to about 10 min, or alternately between about 1 min to about 5 min. In at least one embodiment, the residence time of the internal fluids in furnace 108 is about 2 min.

Soaker feed stream 158 is introduced into soaker 110 to produce soaker effluent stream 160. Soaker 110 can have an internal structure including baffles and sieves to enhance the visbreaking reaction. In some embodiments, soaker 110 can include an external heating element (not shown) or an external insulator (not shown) to maintain the temperature of soaker feed stream 158. In other embodiments, soaker 110 is in the absence of the external heating element. Soaker 110 can be a vertical vessel or a horizontal vessel. The residence time of the internal fluids in soaker 110 can range between about 5 min to about 90 min, alternately between about 10 min to about 60 min, or alternately between about 10 min to about 40 min. In at least one embodiment, the residence time of the internal fluids in soaker 110 is about 25 min. The temperature of soaker effluent stream 160 can be from about 0 deg. C. to about 50 deg. C., alternately from about 5 deg. C to about 40 deg. C., or alternately from about 10 deg. C. to about 30 deg. C. less than that of soaker feed stream 158 due to adiabatic expansion or a certain degree of cooling. In at least one embodiment, soaker effluent stream 160 has a temperature of about 430 deg. C.

Soaker effluent stream 160 is introduced into fractionator 112. Fractionator 112 can include separation columns that are capable of separating soaker effluent stream 160 into visbreaker distillate stream 162 and visbreaker residue stream 164. Visbreaker distillate stream 162 can include hydrocarbons having a TBP 90% less than about 340 deg. C. Hydrocarbons having a TBP 90% less than about 340 deg. C. can include hydrocarbon gas, naphtha, and light gas oil. Visbreaker residue stream 164 can include hydrocarbons having a TBP 10% equal to or greater than about 340 deg. C. Hydrocarbons having a TBP 10% greater than about 340 deg. C. can include vacuum gas oil and vacuum residue. In an alternate embodiment, fractionator 112 can include separation columns that are capable of separating soaker effluent stream 160 into a hydrocarbon gas stream (not shown), a naphtha stream (not shown), a light gas oil stream (not shown), and visbreaker residue stream 164. The hydrocarbon gas stream can include hydrocarbons having a TBP 90% less than about 30 deg. C. The naphtha stream can include hydrocarbons having a TBP 10% of about 30 deg. C. and a TBP 90% of about 180 deg. C. The light gas oil stream can include hydrocarbons having a TBP 10% of about 180 deg. C. and a TBP 90% of about 340 deg. C. Visbreaker residue stream 164 can have a kinematic viscosity ranging between about 500 centistokes (cSt) and about 800 cSt at about 100 deg. C., alternately between about 550 cSt and about 750 cSt at about 100 deg. C., or alternately between about 600 cSt and about 700 cSt at about 100 deg. C. In at least one embodiment, visbreaker residue stream 164 has a kinematic viscosity of about 650 cSt at about 100 deg. C.

Optionally, make-up water feed 161 can be introduced to fractionator 112 used as a stripping steam. Make-up water feed 161 can include superheated steam having a temperature ranging between about 250 deg. C. and about 400 deg. C. and a pressure ranging between about 4 bar and about 15 bar. Make-up water feed 161 can include demineralized water. Water included in make-up water feed 161 can have a conductivity less than about 1.0 microSiemens per centimeter (μS/cm), alternately less than about 0.5 μg/cm, or alternately less than about 0.1 μS/cm. In at least one embodiment, water included in make-up water feed 161 has a conductivity less than about 0.1 μS/cm. Water included in make-up water feed 161 can have a sodium content less than about 10 micrograms per liter (μg/L), alternately less than about 5 μg/L, or alternately less than about 1 μg/L. In at least one embodiment, water included in make-up water feed 161 has a sodium content less than about 1 μg/L. Water included in make-up water feed 161 can have a chloride content less than about 5 μg/L, alternately less than about 3 μg/L, or alternately less than about 1 μg/L. In at least one embodiment, water included in make-up water feed 161 has a chloride content less than about 1 μg/L. Water included in make-up water feed 161 can have a silica content less than about 5 μg/L, alternately less than about 4 μg/L, or alternately less than about 3 μg/L. In at least one embodiment, water included in make-up water feed 161 has a silica content less than about 3 μg/L.

In some embodiments, soaker effluent stream 160 and make-up water feed 161 can be premixed before being introduced to fractionator 112 using any type of mixing device capable of mixing soaker effluent stream 160 and make-up water feed 161, such as a tee junction, a static mixer, an inline mixer, and impeller-embedded mixer. In other embodiments, soaker effluent stream 160 and make-up water feed 161 are separately introduced to fractionator 112. Make-up water feed 161 can have a pressure ranging between about 2 bar and about 55 bar or alternately between about 4 bar and about 15 bar. In at least one embodiment, the pressure of make-up water feed 161 is about 5 bar. Make-up water feed 161 can have a temperature ranging between about 150 deg. C. and about 500 deg. C., alternately between about 200 deg. C. and about 400 deg. C., or alternately between about 250 deg. C. and about 350 deg. C. In at least one embodiment, the temperature of make-up water feed 161 is about 300 deg. C.

Optionally, visbreaker residue stream 164 can be passed to splitter 114. Splitter 114 can be any type of separation device capable of separating visbreaker residue stream 164 into visbreaker residue stream 166 and visbreaker residue stream 167. A portion of visbreaker residue stream 164 is separated to produce visbreaker residue stream 166. The remaining portion of visbreaker residue stream 164 is collected via visbreaker residue stream 167. In other embodiments, visbreaker residue stream 164 does not undergo separation such that visbreaker residue stream 166 is equivalent to visbreaker residue stream 164.

Visbreaker residue stream 166 is passed to pump 116 to produce visbreaker residue stream 168. Pump 116 can be any type of pump capable of increasing the pressure of the visbreaker residue stream 166. Non-limiting examples of pump 116 can include a diaphragm metering pump and a plunger type pump. The pressure of visbreaker residue stream 168 can range between about 220 bar and about 350 bar, alternately between about 240 bar and about 330 bar, or alternately between about 260 bar and about 300 bar. In at least one embodiment, the pressure of visbreaker residue stream 168 is about 270 bar.

Optionally, visbreaker residue stream 166 can be combined with a diluent (not shown) using a mixer (not shown) to reduce the viscosity of visbreaker residue stream 166. The mixer can be any type of mixing device capable of mixing visbreaker residue stream 166 and the diluent. Non-limiting examples of mixing devices suitable for use as the mixer can include a static mixer, an inline mixer, and impeller-embedded mixer. Non-limiting examples of the diluent can include naphtha and light gas oil. The diluent can be a portion of liquid phase stream 180.

Visbreaker residue stream 168 is passed to heat exchanger 118 to produce visbreaker residue stream 170. Heat exchanger 118 can be any type of heat exchanger capable of controlling the temperature of visbreaker residue stream 168. Non-limiting examples of heat exchanger 118 can include an electric heater, a fired heater, steam tracing, a cross exchanger, and a cooling jacket. The temperature of visbreaker residue stream 170 can range between about 100 deg. C. and about 300 deg. C., alternately between about 150 deg. C. and about 250 deg. C., or alternately between about 170 deg. C. and about 220 deg. C. In at least one embodiment, the temperature of visbreaker residue stream 170 is about 190 deg. C. In some embodiments, the temperature of visbreaker residue stream 170 is controlled such that the temperature difference between visbreaker residue stream 170 and water stream 144 (described infra) is less than about 300 deg. C. or alternately less than about 250 deg. C. Without being bound by any theory, such temperature difference is maintained to facilitate mass transfer.

Water feed 140 is introduced to the process 100. Water feed 140 can include demineralized water. Water included in water feed 140 can have a conductivity less than about 1.0 microSiemens per centimeter (μS/cm), alternately less than about 0.5 μS/cm, or alternately less than about 0.1 μS/cm. In at least one embodiment, water included in water feed 140 has a conductivity less than about 0.1 μS/cm. Water included in water feed 140 can have a sodium content less than about 10 micrograms per liter (μg/L), alternately less than about 5 μg/L, or alternately less than about 1 μg/L. In at least one embodiment, water included in water feed 140 has a sodium content less than about 1 μg/L. Water included in water feed 140 can have a chloride content less than about 5 μg/L, alternately less than about 3 μg/L, or alternately less than about 1 μg/L. In at least one embodiment, water included in water feed 140 has a chloride content less than about 1 μg/L. Water included in water feed 140 can have a silica content less than about 5 μg/L, alternately less than about 4 μg/L, or alternately less than about 3 μg/L. In at least one embodiment, water included in water feed 140 has a silica content less than about 3 μg/L.

Water feed 140 is passed to pump 122 to produce water stream 142. Pump 122 can be any type of pump capable of increasing the pressure of water feed 140. Non-limiting examples of pump 122 can include a diaphragm metering pump and a plunger type pump. The pressure of water stream 142 can range between about 220 bar and about 350 bar, alternately between about 240 bar and about 330 bar, or alternately between about 260 bar and about 300 bar. In at least one embodiment, the pressure of water stream 142 is about 270 bar.

Water stream 142 is passed to heat exchanger 124 to produce water stream 144. Heat exchanger 124 can be any type of heat exchanger capable of increasing the temperature of water stream 142. Non-limiting examples of heat exchanger 124 can include an electric heater, a fired heater, steam tracing, and a cross exchanger. The temperature of water stream 144 can range between about 350 deg. C. and about 700 deg. C., alternately between about 400 deg. C. and about 650 deg. C., or alternately between about 450 deg. C. and about 600 deg. C. In at least one embodiment, the temperature of water stream 144 is about 480 deg. C.

Visbreaker residue stream 170 is introduced to SCW reactor 120. Water stream 144 is introduced to SCW reactor 120. In some embodiments, visbreaker residue stream 170 and water stream 144 can be premixed before being introduced to SCW reactor 120 using any type of mixing device capable of mixing visbreaker residue stream 170 and water stream 144, such as a tee junction, a static mixer, an inline mixer, and impeller-embedded mixer. In other embodiments, visbreaker residue stream 170 and water stream 144 are separately introduced to SCW reactor 120. Visbreaker residue stream 170 and water stream 144 are introduced to SCW reactor 120 having a water-to-oil mass flow ratio ranging between about 0.1 and about 10 at standard ambient temperature and pressure (SATP), alternately between about 0.5 and about 7 at SATP, or alternately between about 1 and about 5 at SATP. In at least one embodiment, the water-to-oil mass flow ratio is about 2 at SATP.

SCW reactor 120 is maintained at a temperature and pressure such that the water is in its supercritical state. SCW reactor 120 can be maintained at a temperature ranging between about 374 deg. C. and about 550 deg. C., alternately between about 380 deg. C. and about 500 deg. C., or alternately between about 400 deg. C. and about 450 deg. C. In at least one embodiment, SCW reactor 120 is maintained at a temperature ranging between about 440 deg. C. and about 450 deg. C. Means for maintaining such temperature of SCW reactor 120 can include a strip heater, immersion heater, tubular furnace, heat exchanger, or like devices known in the art. SCW reactor 120 can be maintained at a pressure ranging between about 220.6 bar and about 350 bar, alternately between about 240 bar and about 330 bar, or alternately between about 260 bar and about 300 bar. In at least one embodiment, SCW reactor 120 is maintained at a pressure of about 270 bar. SCW reactor 120 can be a tubular type reactor, a vessel type reactor, and combinations of the same. The residence time of the internal fluids in SCW reactor 120 can range between about 0.1 min and about 60 min, alternately between about 0.5 min and about 45 min, or alternately between about 1 min and about 30 min. In at least one embodiment the residence time of the internal fluids in SCW reactor 120 is about 2 min. The residence time is calculated by assuming that the densities of the reactants in SCW reactor 120 are similar to that of water at operating conditions of SCW reactor 120. In at least one embodiment, SCW reactor 120 is in the absence of an external supply of catalyst. In at least one embodiment, SCW reactor 120 is in the absence of an external supply of hydrogen. The product of SCW reactor 120 is collected via SCW effluent stream 172.

SCW effluent stream 172 is passed to heat exchanger 126 to produce SCW effluent stream 174. Heat exchanger 126 can be any type of heat exchanger capable of reducing the temperature of SCW effluent stream 172. Non-limiting examples of heat exchanger 126 can include a double pipe type exchanger and shell-and-tube type exchanger. The temperature of SCW effluent stream 174 can range between about 0 deg. C. and about 350 deg. C., alternately between about 30 deg. C. and about 330 deg. C., or alternately between about 150 deg. C. and about 280 deg. C. In at least one embodiment, the temperature of SCW effluent stream 174 is about 230 deg. C.

SCW effluent stream 174 is passed to pressure reducer 128 to produce SCW effluent stream 176. Pressure reducer 128 can be any type of device capable of reducing the pressure of a fluid stream. Non-limiting examples of pressure reducer 128 can include a pressure let-down valve, a pressure control valve, and a back pressure regulator. The pressure of SCW effluent stream 176 can range between about 0 bar and about 40 bar, alternately between about 0 bar and about 30 bar, or alternately between about 1 bar and about 15 bar. In at least one embodiment, the pressure of SCW effluent stream 176 is about 10 bar.

SCW effluent stream 176 is introduced into flash column 130. Flash column 130 separates SCW effluent stream 176 into gas phase stream 178 and liquid phase stream 180. Flash column 130 can be a simple fractionator, such as a flash drum. Advantageously, the temperature and pressure of SCW effluent stream 176 are such that a flash drum can be used to separate SCW effluent stream 176 into the gas phase fractions and the liquid phase fractions. Flash column 130 can be designed to generate gas phase components inside. Gas phase stream 178 can include hydrocarbon gas, naphtha, and light gas oil. Gas phase stream 178 includes water. Liquid phase stream 180 can include naphtha, light gas oil, vacuum gas oil, and vacuum residue. Liquid phase stream 180 includes water. The composition, including the hydrocarbon composition and the amount of water, of each of gas phase stream 178 and liquid phase stream 180 depends on the temperature and pressure in flash column 130. The temperature and pressure of flash column 130 can be adjusted to achieve the desired separation between gas phase stream 178 and liquid phase stream 180. The temperature and pressure of flash column 130 can be controlled to achieve a water content in gas phase stream 178 ranging between about 30 wt. % and about 95 wt. %, alternately between about 50 wt. % and about 95 wt. %, or alternately between about 80 wt. % and about 95 wt. %. In at least one embodiment, the water content in gas phase stream 178 is about 91 wt. %. The temperature and pressure of flash column 130 can be controlled to achieve a water content in liquid phase stream 180 ranging between about 30 wt. % and about 80 wt. %, alternately between about 40 wt. % and about 70 wt. %, or alternately between about 50 wt. % and about 60 wt. %. In at least one embodiment, the water content in liquid phase stream 180 is about 58 wt. %. The unconverted fractions from SCW effluent stream 176 are included in liquid phase stream 180. Flash column 130 can include an external heating component (not shown) to increase the temperature of the internal fluid. The external heating component can be any type known in the art capable of maintaining or increasing the temperature in a vessel. Flash column 130 can include an internal heating component (not shown) to increase the temperature of the internal fluid. Flash column 130 can include an internal mixing device. The internal mixing device can by any type of internal mixing device known in the art capable of enhancing mixing of the internal fluid. In at least one embodiment, the internal mixing device is an agitator. Flash column 130 can be maintained at a temperature ranging between about 100 deg. C. and about 300 deg. C., alternately between about 150 deg. C. and about 250 deg. C., or alternately between about 170 deg. C. and about 200 deg. C. In at least one embodiment, flash column 130 is maintained at a temperature of about 183.5 deg. C. Flash column 130 can be maintained at a pressure ranging between about zero bar and about 40 bar, alternately between about zero bar and about 30 bar, or alternately between about 5 bar and about 15 bar. In at least one embodiment, flash column 130 is maintained at a pressure of about 10 bar.

At least a portion of liquid phase stream 180 is reintroduced into the process 100 via liquid phase stream 182. The temperature and pressure of liquid phase stream 182 can be adjusted using a heat exchanger (not shown) and a pump (not shown), respectively, such that liquid phase stream 182 has similar temperature and pressure to that of heavy hydrocarbon stream 154. Liquid phase stream 182 is combined with heavy hydrocarbon stream 154 via mixer 106. Liquid phase stream 182 and heavy hydrocarbon stream 154 can be combined at a mass flow ratio ranging between about 0.01 and about 0.2 at SATP, alternately between about 0.01 and about 0.15 at SATP, or alternately between about 0.05 and about 0.1 at SATP. In at least one embodiment, liquid phase stream 182 and heavy hydrocarbon stream 154 are combined at a mass flow ratio of about 0.07 at SATP. Advantageously, because liquid phase stream 182 includes well-mixed water, the introduction of liquid phase stream 182 into visbreaker unit 190 (including furnace 108, soaker 110, and fractionator 112) facilitates water to participate in the visbreaking process as a diluent, a heat transfer medium, and in certain cases, a hydrogen source. For example, in soaker 110, water present in the soaker feed stream 158 can strip relatively lighter products that can be embedded in the heavy hydrocarbon fraction by creating a bubbling effect. In this manner, coke formation can be suppressed while the conversion rate of heavy hydrocarbons can be increased and the viscosity of the visbroken product can be decreased. Advantageously, water present in soaker effluent stream 160 originating from liquid phase stream 182 can be used to compensate the quantity of stripping steam that can be required in fractionator 112. In this manner, less or minimal water can be provided by make-up water feed 161.

Optionally, a portion of gas phase stream 178 can be reintroduced into the process 100 via gas phase stream 184. The temperature and pressure of gas phase stream 184 can be adjusted using a heat exchanger (not shown) and a pump (not shown), respectively, such that gas phase stream 184 has similar temperature and pressure to that of heavy hydrocarbon stream 154. Gas phase stream 184 can be combined with heavy hydrocarbon stream 154 and liquid phase stream 182 via mixer 106. Gas phase stream 184 and heavy hydrocarbon stream 154 can be combined at a mass flow ratio ranging between about 0.001 and about 0.2 at SATP, alternately between about 0.01 and about 0.2 at SATP, or alternately between about 0.05 and about 0.15 at SATP. In at least one embodiment, gas phase stream 184 and heavy hydrocarbon stream 154 are combined at a mass flow ratio of about 0.12 at SATP. Advantageously, because gas phase stream 184 includes water (typically in the form of steam), the introduction of gas phase stream 184 into visbreaker unit 190 (including furnace 108, soaker 110, and fractionator 112) facilitates water to participate in the visbreaking process as a diluent, a heat transfer medium, and in certain cases, a hydrogen source. For example, in soaker 110, water present in the soaker feed stream 158 can strip relatively lighter products that can be embedded in the heavy hydrocarbon fraction by creating a bubbling effect. In this manner, coke formation can be suppressed while the conversion rate of heavy hydrocarbons can be increased and the viscosity of the visbroken product can be decreased. Advantageously, the introduction of gas phase stream 184 into visbreaker unit 190 (including furnace 108, soaker 110, and fractionator 112) facilitates light hydrocarbons to participate in the visbreaking process as a diluent. Advantageously, olefinic compounds that can be present in gas phase stream 184 can be converted to non-olefinic compounds such as aromatics by undergoing alkylation reactions during the visbreaking process. Advantageously, naphthenic compounds that can be present in gas phase stream 184 can serve as a hydrogen donor during the visbreaking process. Advantageously, water present in soaker effluent stream 160 originating from gas phase stream 184 can be used to compensate the quantity of stripping steam that can be required in fractionator 112. In this manner, less or minimal water can be provided by make-up water feed 161.

Optionally, a portion of gas phase stream 178 can be reintroduced into the process 100 via gas phase stream 186. Gas phase stream 186 can be introduced into fractionator 112. Gas phase stream 186 can have a pressure ranging between about 2 bar and about 55 bar or alternately between about 4 bar and about 15 bar. In at least one embodiment, the pressure of gas phase stream 186 is about 5 bar. The pressure of gas phase stream 186 can be adjusted by using a pump (not shown) before being introduced into fractionator 112. Gas phase stream 186 can have a temperature ranging between about 100 deg. C. and about 500 deg. C., alternately between about 200 deg. C. and about 400 deg. C., or alternately between about 250 deg. C. and about 350 deg. C. In at least one embodiment, the temperature of gas phase stream 186 is about 300 deg. C. The temperature of gas phase stream 186 can be increased by using a heat exchanger (not shown) before being introduced into fractionator 112. Advantageously, because gas phase stream 186 includes water (typically in the form of steam), the introduction of gas phase stream 186 into fractionator 112 can serve as a substitute of make-up water feed 161 for stripping the visbreaker distillate from the visbreaker residue to produce visbreaker distillate stream 162 and visbreaker residue stream 164, respectively. The quantity of water introduced into fractionator 112 provided by gas phase stream 186 can be controlled such that make-up water feed 161 is no longer required.

Figure 2A:
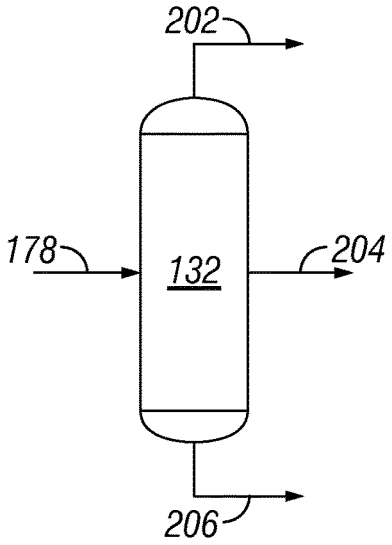
FIG. 2A-C are schematic diagrams of gas-oil-water separators used in a process for upgrading heavy hydrocarbons according to an embodiment of the disclosure.

Optionally, gas phase stream 178 can be further introduced to gas-oil-water separator 132 as shown in FIG. 2A. Gas-oil-water separator 132 separates gas phase stream 178 into gas product 202, oil product 204, and water product 206. Gas-oil-water separator 132 can include multiple separation units in series or can include a single three-phase separator. In an embodiment, gas-oil-water separator 132 includes a gas-liquid separator and an oil-water separator. Gas phase stream 178 can be introduced to the gas-liquid separator which separates gas phase stream 178 into gas product 202 and a liquid product (not shown). The liquid product can be further introduced to the oil-water separator which separates the liquid product into oil product 204 and water product 206. In an embodiment, gas-oil-water separator 132 includes a three-phase separator. Gas phase stream 178 can be introduced to the three-phase separator which separates gas phase stream 178 into gas product 202, oil product 204, and water product 206. The three-phase separator can be any type of separation unit capable of separating a stream into a gas phase component, an oil component, and a water component. Optionally, before gas phase stream 178 is introduced to gas-oil-water separator 132, gas phase stream 178 can be passed to a heat exchanger (not shown) to reduce the temperature of gas phase stream 178. Non-limiting examples of the heat exchanger can include a double pipe type exchanger and shell-and-tube type exchanger. Gas phase stream 178 can be cooled to a temperature ranging between about 0 deg. C. and about 100 deg. C., alternately between about 30 deg. C. and about 70 deg. C., or alternately between about 40 deg. C. and about 60 deg. C. In at least one embodiment, gas phase stream 178 can be cooled to a temperature of about 50 deg. C. Optionally, before gas phase stream 178 is introduced to gas-oil-water separator 132, gas phase stream 178 can be passed to a pressure reducer (not shown) to reduce the pressure of gas phase stream 178. Non-limiting examples of the pressure reducer can include a pressure let-down valve, a pressure control valve, and a back pressure regulator. Gas phase stream 178 can be depressurized to a pressure ranging between about 0 bar and about 10 bar, alternately between about 0 bar and about 5 bar, or alternately between about 0.5 bar and about 2 bar. In at least one embodiment, gas phase stream 178 can be depressurized to a pressure of about 1 bar. Water product 206 can be recycled for use as water feed 140 or optional make-up water feed 161, can be further processed, such as in a demineralization process, to remove any impurities and then recycled for use as water feed 140 or optional make-up water feed 161, or can be collected for storage or disposal.

Figure 2B:
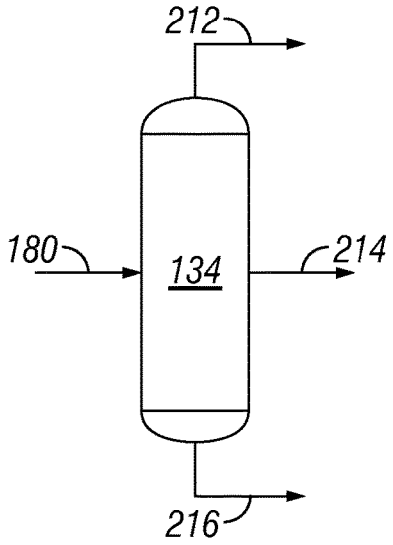

Optionally, liquid phase stream 180 can be further introduced to gas-oil-water separator 134 as shown in FIG. 2B. Gas-oil-water separator 134 separates liquid phase stream 180 into gas product 212, oil product 214, and water product 216. Gas-oil-water separator 134 can include multiple separation units in series or can include a single three-phase separator. In an embodiment, gas-oil-water separator 134 includes a gas-liquid separator and an oil-water separator. Liquid phase stream 180 can be introduced to the gas-liquid separator which separates liquid phase stream 180 into gas product 212 and a liquid product (not shown). The liquid product can be further introduced to the oil-water separator which separates the liquid product into oil product 214 and water product 216. In an embodiment, gas-oil-water separator 134 includes a three-phase separator. Liquid phase stream 180 can be introduced to the three-phase separator which separates liquid phase stream 180 into gas product 212, oil product 214, and water product 216. The three-phase separator can be any type of separation unit capable of separating a stream into a gas phase component, an oil component, and a water component. Optionally, before liquid phase stream 180 is introduced to gas-oil-water separator 134, liquid phase stream 180 can be passed to a heat exchanger (not shown) to reduce the temperature of liquid phase stream 180. Non-limiting examples of the heat exchanger can include a double pipe type exchanger and shell-and-tube type exchanger. Liquid phase stream 180 can be cooled to a temperature ranging between about 0 deg. C and about 100 deg. C., alternately between about 30 deg. C. and about 70 deg. C., or alternately between about 40 deg. C. and about 60 deg. C. In at least one embodiment, liquid phase stream 180 can be cooled to a temperature of about 50 deg. C. Optionally, before liquid phase stream 180 is introduced to gas-oil-water separator 134, liquid phase stream 180 can be passed to a pressure reducer (not shown) to reduce the pressure of liquid phase stream 180. Non-limiting examples of the pressure reducer can include a pressure let-down valve, a pressure control valve, and a back pressure regulator. Liquid phase stream 180 can be depressurized to a pressure ranging between about 0 bar and about 10 bar, alternately between about 0 bar and about 5 bar, or alternately between about 0.5 bar and about 2 bar. In at least one embodiment, liquid phase stream 180 can be depressurized to a pressure of about 1 bar. Water product 216 can be recycled for use as water feed 140 or optional make-up water feed 161, can be further processed, such as in a demineralization process, to remove any impurities and then recycled for use as water feed 140 or optional make-up water feed 161, or can be collected for storage or disposal.

Figure 2C:
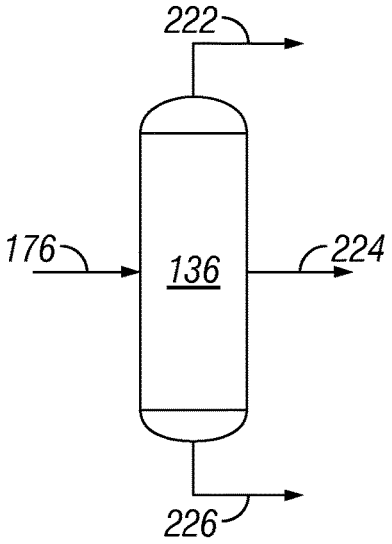

In an alternate embodiment, SCW effluent stream 176 can be further introduced to gas-oil-water separator 136 as shown in FIG. 2C. Gas-oil-water separator 136 separates SCW effluent stream 176 into gas product 222, oil product 224, and water product 226. Gas-oil-water separator 136 can include multiple separation units in series or can include a single three-phase separator. In an embodiment, gas-oil-water separator 136 includes a gas-liquid separator and an oil-water separator. SCW effluent stream 176 can be introduced to the gas-liquid separator which separates SCW effluent stream 176 into gas product 222 and a liquid product (not shown). The liquid product can be further introduced to the oil-water separator which separates the liquid product into oil product 224 and water product 226. In an embodiment, gas-oil-water separator 136 includes a three-phase separator. SCW effluent stream 176 can be introduced to the three-phase separator which separates SCW effluent stream 176 into gas product 222, oil product 224, and water product 226. The three-phase separator can be any type of separation unit capable of separating a stream into a gas phase component, an oil component, and a water component. Gas-oil-water separator 136 can be operated at a temperature ranging between about 0 deg. C. and about 100 deg. C., alternately between about 30 deg. C. and about 70 deg. C., or alternately between about 40 deg. C. and about 60 deg. C. In at least one embodiment, gas-oil-water separator 136 is operated at a temperature of about 50 deg. C. Gas-oil-water separator 136 can be operated at a pressure ranging between about 0 bar and about 10 bar, alternately between about 0 bar and about 5 bar, or alternately between about 0.5 bar and about 2 bar. In at least one embodiment, gas-oil-water separator 136 is operated at a pressure of about 1 bar. Water product 226 can be recycled for use as water feed 140 or optional make-up water feed 161, can be further processed, such as in a demineralization process, to remove any impurities and then recycled for use as water feed 140 or optional make-up water feed 161, or can be collected for storage or disposal.

EXAMPLES

The disclosure is illustrated by the following examples, which are presented for illustrative purposes only, and are not intended as limiting the scope of the invention which is defined by the appended claims.

A process having a configuration similar to FIG. 1 was modelled using the HYSYS Hydroprocessing Model (Aspen Technology, Inc., Bedford Mass.). Certain data inputs used in the simulation were obtained by conducting lab experiments, such as upgrading visbreaker residue. In reference to the properties of the stream for Comparative Example and Example, the description and stream numbers for FIGS. 1 and 2A-2C are used.

Comparative Example

A heavy hydrocarbon feed (stream 150) was introduced to the respective process. The heavy hydrocarbon feed was a vacuum residue produced from a vacuum distillation unit having a composition and properties as shown in Table 1. The pressure of the heavy hydrocarbon feed was maintained at about 38 bar (stream 152). The temperature of the heavy hydrocarbon feed was maintained at about 250 deg. C. (stream 154).

TABLE 1

| | |
|---|---|
| API Gravity | 2.5 |
| Sulfur Content (wt. %) | 5.4 |
| Distillation Properties (deg. C.) | |
| TBP 5% | 576.5 |
| TBP 10% | 591.7 |
| TBP 30% | 647.4 |
| TBP 50% | 723.1 |
| TBP 70% | 823.5 |
| Kinematic Viscosity at 37.8 deg. C. (cSt) | 35,060 |
| Asphaltenes (wt. %) | 10.9 |
| Microcarbon Residue (wt. %) | 23.3 |

The heavy hydrocarbon feed was introduced to a furnace (unit 108). The furnace increased the temperature of the heavy hydrocarbon feed to 450 deg. C. The residence time of the internal fluids in the furnace was about 2 min. The furnace produced a heated heavy hydrocarbon stream (stream 158).

The heated heavy hydrocarbon stream was introduced to a soaker (unit 110). The residence time of the internal fluids in the soaker was about 25 min. The soaker produced a soaker effluent stream (stream 160). The temperature of the soaker effluent stream was about 430 deg. C.

The soaker effluent stream was combined with a make-up steam feed (stream 161) where the mixed stream was introduced to a fractionator (unit 112). The make-up steam feed had a pressure of about 41 bar and a temperature of about 300 deg. C. The soaker effluent stream was fractionated into a gas stream, a naphtha stream, a light gas oil stream, and a visbreaker residue stream (stream 164). The visbreaker residue stream had a kinematic viscosity of about 650 cSt at about 99 deg. C. The soaker effluent stream had a composition as shown in Table 2. The distribution of the distillate (that is, naphtha and light gas oil) after visbreaking was about 11.3 wt. %.

TABLE 2

| | TBP 10% (deg. C.) | TBP 90% (deg. C.) | Distribution (wt. %) | API Gravity |
|---|---|---|---|---|
| Gas | — | 30 | 3.4 | — |
| Naphtha | 30 | 180 | 4.2 | 57.2 |
| Light Gas Oil | 180 | 340 | 7.1 | 32.3 |
| Visbreaker Residue | 340 | — | 85.4 | 6.41 |

The pressure of the visbreaker residue stream was maintained at about 270 bar (stream 168). The temperature of the visbreaker residue stream was maintained at about 190 deg. C. (stream 170).

A water feed (stream 140) was introduced to the respective process. The water was a demineralized water and had a conductivity of less than about 0.1 μS/cm, a sodium content of less than about 1 μg/L, a chloride content of less than about 1 μg/L, and a silica content of less than about 3 μg/L. The pressure of the water feed was maintained at about 270 bar (stream 142). The temperature of the water feed was maintained at about 480 deg. C. (stream 144).

The visbreaker residue stream and the water feed were combined where the mixed stream was introduced to a SCW reactor (unit 120). The water-to-oil volume ratio of the mixed stream was about 2 at SATP. The SCW reactor included five tubular reactors of the same size arranged horizontally and fluidly connected in series. The aspect ratio (that is, the ratio between the length and the internal diameter) of a single reactor was about 93. The superficial velocity of the internal stream was about 0.15 meters per second (m/s). The SCW reactor was maintained at a temperature ranging between about 440 deg. C. and about 450 deg. C. and a pressure of about 270 bar. The residence time of the internal fluids in the SCW reactor was about 2 min. The SCW reactor produced an SCW effluent stream (stream 172). The SCW effluent stream was cooled to a temperature of about 230 deg. C. (stream 174). The SCW effluent stream was depressurized to a pressure of about 10 bar (stream 176). The SCW effluent stream had a composition as shown in Table 3.

TABLE 3

| | TBP 10% (deg. C.) | TBP 90% (deg. C.) | Distribution (wt. %) | API Gravity |
|---|---|---|---|---|
| Gas | — | 30 | 1.6 | — |
| Naphtha | 30 | 180 | 7.8 | 52.1 |
| Light Gas Oil | 180 | 340 | 18.2 | 29.8 |
| Vacuum Gas oil | 340 | 565 | 24.4 | 18.9 |
| Vacuum Residue | 565 | — | 48.0 | 7.2 |

Overall, the process converted vacuum residue into hydrocarbon products having a composition as shown in Table 4. By visbreaking the vacuum residue followed by processing the visbreaker residue using the SCW reactor, the distribution of the distillate (that is, naphtha and light gas oil) was about 31.6 wt. % (=10.3+21.3), compared to about 11.3 wt. % (=4.2+7.1) using visbreaking alone.

TABLE 4

| | TBP 10% (deg. C.) | TBP 90% (deg. C.) | Distribution before Process (wt. %) | Distribution after Process (wt. %) |
|---|---|---|---|---|
| Gas | — | 30 | — | 4.6 |
| Naphtha | 30 | 180 | — | 10.3 |
| Light Gas Oil | 180 | 340 | — | 21.3 |
| Vacuum Gas oil | 340 | 565 | — | 26.1 |
| Vacuum Residue | 565 | — | 100.0 | 37.5 |
| Total | — | — | 100.0 | 99.8 |

Example

A heavy hydrocarbon feed (stream 150) was introduced to the respective process. The heavy hydrocarbon feed was a vacuum residue produced from a vacuum distillation unit having a composition and properties as shown in Table 1. The pressure of the heavy hydrocarbon feed was maintained at about 38 bar (stream 152). The temperature of the heavy hydrocarbon feed was maintained at about 250 deg. C. (stream 154).

The heavy hydrocarbon feed was introduced to a furnace (unit 108). The furnace increased the temperature of the heavy hydrocarbon feed to 450 deg. C. The residence time of the internal fluids in the furnace was about 2 min. The furnace produced a heated heavy hydrocarbon stream (stream 158).

The heated heavy hydrocarbon stream was introduced to a soaker (unit 110). The residence time of the internal fluids in the soaker was about 25 min. The soaker produced a soaker effluent stream (stream 160). The temperature of the soaker effluent stream was about 430 deg. C.

The soaker effluent stream was combined with a make-up steam feed (stream 161) where the mixed stream was introduced to a fractionator (unit 112). The make-up steam feed had a pressure of about 41 bar and a temperature of about 300 deg. C. The soaker effluent stream was fractionated into a gas stream, a naphtha stream, a light gas oil stream, and a visbreaker residue stream (stream 164). The visbreaker residue stream had a kinematic viscosity of about 650 cSt at about 99 deg. C. The soaker effluent stream had a composition as shown in Table 2. The distribution of the distillate (that is, naphtha and light gas oil) after visbreaking was about 11.3 wt. %.

The pressure of the visbreaker residue stream was maintained at about 270 bar (stream 168). The temperature of the visbreaker residue stream was maintained at about 190 deg. C. (stream 170).

A water feed (stream 140) was introduced to the respective process. The water was a demineralized water and had a conductivity of less than about 0.1 μS/cm, a sodium content of less than about 1 μg/L, a chloride content of less than about 1 μg/L, and a silica content of less than about 3 μg/L. The pressure of the water feed was maintained at about 270 bar (stream 142). The temperature of the water feed was maintained at about 480 deg. C. (stream 144).

The visbreaker residue stream and the water feed were combined where the mixed stream was introduced to a SCW reactor (unit 120). The water-to-oil volume ratio of the mixed stream was about 2 at SATP. The SCW reactor included five tubular reactors of the same size arranged horizontally and fluidly connected in series. The aspect ratio (that is, the ratio between the length and the internal diameter) of a single reactor was about 93. The superficial velocity of the internal stream was about 0.15 meters per second (m/s). The SCW reactor was maintained at a temperature ranging between about 440 deg. C. and about 450 deg. C. and a pressure of about 270 bar. The residence time of the internal fluids in the SCW reactor was about 2 min. The SCW reactor produced an SCW effluent stream (stream 172). The SCW effluent stream was cooled to a temperature of about 230 deg. C. (stream 174). The SCW effluent stream was depressurized to a pressure of about 10 bar (stream 176). The SCW effluent stream had a composition as shown in Table 3.

The SCW effluent stream was introduced to a flash column (unit 130). The SCW effluent stream was separated into a gas phase stream (stream 178) and a liquid phase stream (stream 180). The flash column was maintained at a temperature of about 183.5 deg. C. and a pressure of about 10 bar such that about 29 wt. % gas phase stream and about 71 wt. % liquid phase stream were produced. The gas phase stream included hydrocarbons having boiling points less than about 360 deg. C. The gas phase stream had a water content of about 91 wt. %. The liquid phase stream included hydrocarbons having boiling points greater than about 360 deg. C. The liquid phase stream had a water content of about 58 wt. %.

A portion of the liquid phase stream (stream 182) obtained from the flash column was recycled by combining with the heavy hydrocarbon feed (stream 156). The mass flow ratio between the liquid phase stream and the heavy hydrocarbon feed was about 0.07 at SATP.

A portion of the gas phase stream (stream 184) obtained from the flash column was recycled by combining with the heavy hydrocarbon feed and the liquid phase stream (stream 156). The mass flow ratio between the gas phase stream and the heavy hydrocarbon feed was about 0.12 at SATP.

Operating conditions of the furnace were adjusted. The temperature of the mixed feed (stream 156) in the furnace was increased and maintained at about 465 deg. C. The residence time of the internal fluids in the furnace was increased to about 2.5 min by changing the furnace coil to a longer one.

The heating heavy hydrocarbon stream produced by the furnace was introduced to the soaker. The residence time of the internal fluids in the soaker was about 25 min. The temperature of the soaker effluent stream produced by the soaker was about 440 deg. C.

The soaker effluent stream was introduced to the fractionator without the make-up steam feed. The soaker effluent stream was fractionated into the gas stream, the naphtha stream, the light gas oil stream, and the visbreaker residue stream. The visbreaker residue stream had a kinematic vicosity of about 630 cSt at about 99 deg. C. The soaker effluent stream had a composition as shown in Table 5.

TABLE 5

| | TBP 10% (deg. C.) | TBP 90% (deg. C.) | Distribution (wt. %) | API Gravity |
|---|---|---|---|---|
| Gas | — | 30 | 7.8 | — |
| Naphtha | 30 | 180 | 11.7 | 53.2 |
| Light Gas Oil | 180 | 340 | 16.0 | 31.5 |
| Visbreaker Residue | 340 | — | 68.6 | 7.84 |

As shown by comparing Tables 2 and 5, the distribution of the visbreaker residue decreased from about 85.4 wt. % to about 68.6 wt. % by recycling the liquid phase stream and the gas phase stream to the visbreaking process. Significant quantities of water and light hydrocarbons present in the furnace and the soaker reduced coking tendency at relatively greater temperatures prolonging the residence time in the furnace. In addition, the quantity of water present in the soaker effluent stream was sufficient for steam stripping in the fractionator where an additional water source such as the make-up steam feed was no longer necessary.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. A method for upgrading heavy hydrocarbons, the method comprising the steps of:

introducing a heavy hydrocarbon feed to a furnace to produce a soaker feed stream, wherein the heavy hydrocarbon feed comprises the heavy hydrocarbons;

introducing the soaker feed stream to a soaker to produce a soaker effluent stream;

introducing the soaker effluent stream to a fractionator to produce a visbreaker distillate stream and a visbreaker residue stream, wherein the visbreaker distillate stream comprises hydrocarbons having a true boiling point (TBP) less than that of the visbreaker residue stream;

introducing the visbreaker residue stream and a water feed to a supercritical water (SCW) reactor, wherein the SCW reactor is operated at a pressure equal to or greater than 220.6 bar and a temperature equal to or greater than 373.9 deg. C. to produce an SCW effluent stream;

introducing the SCW effluent stream to a flash column to produce a gas phase stream and a liquid phase stream, wherein the gas phase stream comprises water, wherein the gas phase stream has a water content ranging between 80 wt. % and 95 wt. %, wherein the liquid phase stream comprises water, wherein the liquid phase stream has a water content ranging between 50 wt. % and 60 wt. %; and combining a portion of the liquid phase stream and the heavy hydrocarbon feed.

2. The method of claim 1, wherein the heavy hydrocarbons are selected from the group consisting of: an atmospheric residue fraction, a vacuum residue fraction, and combinations thereof.

3. The method of claim 1, further comprising the step of:

combining a portion of the gas phase stream and the heavy hydrocarbon feed.

4. The method of claim 1, further comprising the steps of:

pressurizing the heavy hydrocarbon feed to a pressure ranging between 30 bar and 40 bar; and heating the heavy hydrocarbon feed to a temperature ranging between 150 deg. C. and about 350 deg. C.

5. The method of claim 1, wherein the furnace is operated such that the soaker feed stream has a temperature ranging between 425 deg. C. and 500 deg. C.

6. The method of claim 1, wherein the soaker effluent stream has a temperature ranging between 375 deg. C. and about 450 deg. C.

7. The method of claim 1, wherein the visbreaker distillate stream comprises hydrocarbons having a TBP less than 340 deg. C.

8. The method of claim 1, further comprising the step of:

introducing a make-up water feed to the fractionator.

9. The method of claim 1, further comprising the step of:

introducing a portion of the gas phase stream to the fractionator.

10. The method of claim 1, further comprising the steps of:

pressurizing the visbreaker residue stream to a pressure ranging between 260 bar and 300 bar; and heating the visbreaker residue stream to a temperature ranging between 170 deg. C. and about 220 deg. C.

11. The method of claim 1, further comprising the steps of:

pressurizing the water feed to a pressure ranging between 260 bar and 300 bar; and heating the water feed to a temperature ranging between 450 deg. C. and about 600 deg. C.

12. The method of claim 1, wherein the visbreaker residue stream and the water feed are introduced to the SCW reactor having a water-to-oil mass flow ratio ranging between 1 and 5.

13. The method of claim 1, further comprising the steps of:

cooling the SCW effluent stream to a temperature ranging between 150 deg. C. and about 280 deg. C.; and depressurizing the SCW effluent stream to a pressure ranging between 1 bar and 15 bar.

14. The method of claim 1, wherein the gas phase stream comprises hydrocarbons having a TBP 90% less than 360 deg. C. and the liquid phase stream comprises hydrocarbons having a TBP 10% equal to or greater than 360 deg. C.

* * * * *